US011746563B2

(12) United States Patent
Martin et al.

(10) Patent No.: US 11,746,563 B2
(45) Date of Patent: Sep. 5, 2023

(54) SMART DOOR LOCK

(71) Applicant: Level Home, Inc., Redwood City, CA (US)

(72) Inventors: John H. Martin, Atherton, CA (US); Kenneth D. Goto, Redwood City, CA (US)

(73) Assignee: Level Home, Inc., Redwood City, CA (US)

( * ) Notice: Subject to any disclaimer, the term of this patent is extended or adjusted under 35 U.S.C. 154(b) by 261 days.

(21) Appl. No.: 17/113,943

(22) Filed: Dec. 7, 2020

(65) Prior Publication Data

US 2021/0172203 A1 Jun. 10, 2021

Related U.S. Application Data

(60) Provisional application No. 62/944,108, filed on Dec. 5, 2019.

(51) Int. Cl.

| | |
|---|---|
| ***E05B 47/00*** | (2006.01) |
| ***E05B 9/02*** | (2006.01) |
| *G07C 9/00* | (2020.01) |

(52) U.S. Cl.

CPC ..... *E05B 47/0001* (2013.01); *E05B 9/02* (2013.01); *E05B 47/0038* (2013.01); *E05Y 2900/132* (2013.01); *G07C 9/00182* (2013.01)

(58) Field of Classification Search

CPC ..... E05B 2047/0014; E05B 2047/0016; E05B 2047/0018; E05B 2047/002;

(Continued)

(56) References Cited

U.S. PATENT DOCUMENTS 10,145,143 B1 * 12/2018 Mohammed ..... E05B 1/003
2012/0234058 A1 * 9/2012 Neil ..... G07C 9/00571 70/91

(Continued)

FOREIGN PATENT DOCUMENTS

KR 20160052767 A * 5/2016 ..... E05B 47/00
WO 2019169119 A1 9/2019

OTHER PUBLICATIONS

International Search Report and Written Opinion dated Mar. 2, 2021 for PCT Application No. PCT/US20/63605, 9 pages.

*Primary Examiner* — Christine M Mills
*Assistant Examiner* — Peter H Watson
(74) *Attorney, Agent, or Firm* — Perkins Coie LLP; Colin Fowler

(57) ABSTRACT

A smart door lock includes a main housing configured to be disposed interior of a standard bore hole of a door. An outer housing is disposed exterior of a secure environment and electrically and mechanically connected to the main housing via conductive prongs. An inner housing is disposed interior of the secure environment. A rotating member is magnetically attached to the inner housing. A deadbolt within a bolt housing transitions between a locked position and an unlocked position in response to the door lock detecting a user device within a wireless communication range, detecting a touch on a sensor of the outer housing, or rotation of the rotating member. The outer housing includes leakage regions to facilitate transmission of wireless signals to the main housing.

19 Claims, 13 Drawing Sheets

(58) Field of Classification Search
CPC ..... E05B 2047/0024; E05B 2047/0026; E05B 2047/003; E05B 2047/0034; E05B 2047/0036; E05B 2047/0048; E05B 2047/0053; E05B 2047/0057; E05B 2047/0058; E05B 2047/0059; E05B 2047/0067; E05B 2047/0069; E05B 2047/0072; E05B 2047/0081; E05B 2047/0084; E05B 2047/0094; E05B 2047/0095; E05B 63/0056; E05B 63/06; E05B 9/002; E05B 9/02; E05B 39/007; E05B 1/0007; E05B 1/003; E05B 2009/004; E05B 15/0205; E05B 15/10; E05B 15/1621; E05B 2015/023; E05B 45/06; E05B 2045/067; E05B 51/005; E05B 47/02; E05B 47/026; E05B 47/00; E05B 47/0001; E05B 47/0012; E05B 47/0038; E05B 2047/0091; E05B 2047/009; E05B 2047/0098
See application file for complete search history.

(56) References Cited

U.S. PATENT DOCUMENTS

| | | | | |
|---|---|---|---|---|
| 2014/0260449 | A1 | 9/2014 | Uyeda et al. | |
| 2017/0114570 | A1* | 4/2017 | Hallett | E05B 63/0056 |
| 2017/0116801 | A1* | 4/2017 | Hallett | E05B 15/16 |
| 2018/0171668 | A1* | 6/2018 | Martin | G07C 9/00944 |
| 2019/0178003 | A1 | 6/2019 | Martin et al. | |

* cited by examiner

SMART DOOR LOCK

CROSS-REFERENCE TO RELATED APPLICATION(S)

This application claims benefit of U.S. Provisional Application Ser. No. 62/944,108, filed Dec. 5, 2019, entitled "Smart Door Lock," which is incorporated herein by reference in its entirety.

TECHNICAL FIELD

This disclosure relates to electromechanical door locks.

BACKGROUND

Locks can be configured to fasten doors to inhibit unauthorized entry into buildings. Conventional deadbolts are moved to an open position by rotating a lock cylinder with a key. Conventional spring bolt locks use a spring to hold a bolt in place, allowing retraction by applying force to the bolt itself. A deadbolt is often used to complement a spring-bolt lock on an entry door to a building.

In many cases, bolt locks may include electronically-powered mechanisms that facilitate automatic movement of a bolt between an unlocked position and a locked position. However, to accommodate components to facilitate automatic movement of the bolt, current electronic bolt locks require cumbersome hardware that extend exterior of a door. For example, some conventional electronic deadbolts include a large cylinder that protrudes out of a door. A side of the cylinder can include a paddle, or a twist knob. The rotation of the cylinder using the key (inserted into the key slot and rotated) or the paddle (moved or rotated to another position) can result in the deadbolt of the lock to retract (e.g., to unlock the door) or extend (e.g., to lock the door). However, some homeowners find it cumbersome to be limited to locking or unlocking the door lock of a door using the key or the paddle. In addition, current electronic bolt locks are difficult to install because of such cumbersome hardware and the wiring used for their electronic components.

Mechanical movement of a bolt may be configured to initiate upon reception of a communication signal. However, to consistently obtain wireless signals from a remote device, an antenna of the deadbolt mechanism may protrude exterior of the door. Locking mechanisms with a footprint that protrudes from a door may limit aesthetic appeal of the locking mechanism. Such a locking mechanism may have a greater vulnerability to unauthorized manipulation, such as breaking the locking mechanism to allow unauthorized entry.

SUMMARY

The disclosed embodiments include at least one door lock. The door lock can include a main housing, a bolt housing, an outer housing, and an inner housing. The main housing can be configured to be disposed interior of a door and to cause a deadbolt within the bolt housing to extend into a locked position or retract into an unlocked position. The main housing can include mechanical components to move the deadbolt and electronic components to operate the mechanical components.

The outer housing can be disposed exterior of the door. The outer housing can include conductive prongs. The conductive prongs can extend through openings of the main housing and engage with the inner housing to secure the components of the door lock. The conductive prongs can connect to conductive openings of the main housing and allow for electrical transmission between the outer housing and the main housing.

The outer housing can include leakage areas configured to facilitate wireless signal transmission between an antenna within the main housing of the door lock and an exterior of the door. The leakage areas can be configured to be disposed adjacent to the door.

The bolt housing can be configured to surround a power supply, such as a battery, disposed within the bolt housing. The power supply can be within the deadbolt. The bolt housing can be expandable to accommodate different size bolt caps that satisfy various bore hole sizes of a door. The bolt caps can be configured to allow for electrical transmission from the power supply to the main housing. While a battery can be disposed within the bolt housing, other components that allow for mechanical movement of the deadbolt between a locked position and an unlocked position can be disposed within the main housing.

The inner housing can be disposed exterior of the door and can face a secure environment, such as the interior of a house. The inner housing can include a first magnet. The inner housing can include a rotation member that facilitates manual transition of the deadbolt between the unlocked position and the locked position. The rotation member can include a second magnet with a second polarity. The magnets can allow for smooth rotation of the rotation member about the inner housing. The magnets can be configured to allow for magnetically favored orientations of the rotation member relative to the inner housing.

The disclosed embodiments include at least one method. The method can include installing a door lock in a door by disposing a bolt housing including a deadbolt within a door, disposing a main housing within a bore hole of the door, and extending a conductive prong of an outer housing to the main housing, wherein the outer housing includes a capacitive touch sensor. The method can further include associating the door lock with a user device, detecting the user device is within a wireless communication range of the door lock, and detecting a touch on the capacitive touch sensor. In response to detecting the touch, detecting the user device within the wireless communication range, or both, the deadbolt transitions between a locked position and an unlocked position.

BRIEF DESCRIPTION OF THE DRAWINGS

Like reference numerals refer to corresponding parts throughout the figures and specification.

DETAILED DESCRIPTION

In the following description, numerous specific details are set forth such as examples of specific components, circuits, and processes to provide a thorough understanding of the present disclosure. Also, in the following description and for purposes of explanation, specific nomenclature is set forth to provide a thorough understanding of the present embodiments. However, it will be apparent to one skilled in the art that these specific details may not be required to practice the present embodiments. In other instances, well-known circuits and devices are shown in block diagram form to avoid obscuring the present disclosure.

Any of the signals provided over various buses described herein may be time-multiplexed with other signals and provided over one or more common buses. Additionally, the interconnection between circuit elements or software blocks may be shown as buses or as single signal lines. Each of the buses may alternatively be a single signal line, and each of the single signal lines may alternatively be buses, and a single line or bus might represent any one or more of a myriad of physical or logical mechanisms for communication (e.g., a network) between components. The present embodiments are not to be construed as limited to specific examples described herein but rather to include within their scope all embodiments defined by the appended claims.

System Overview

Figure 1:
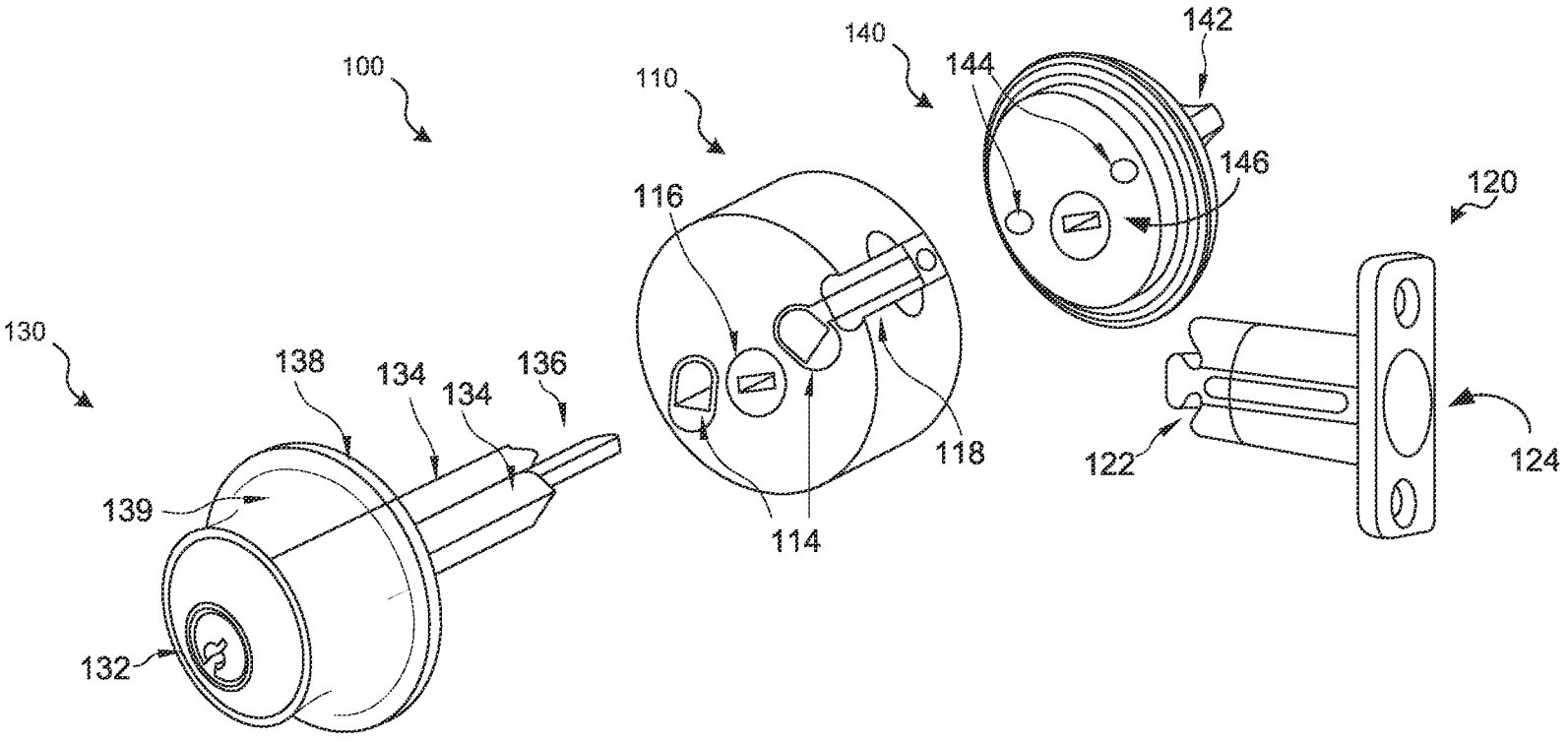
FIG. 1 shows a perspective view of an example door lock.

FIG. 1 is a perspective view of an example door lock 100. The door lock 100 can include a main housing 110, bolt housing 120, outer housing 130, and inner housing 140.

The main housing 110 can include components to mechanically move a deadbolt between a locked position and an unlocked position. For example, the main housing 110 can include an actuator, gear drive, or any other components that can assist in mechanically moving a deadbolt between a locked position and an unlocked position. For example, the main housing 110 can include a motor that can be activated (e.g., turned on) to retract or extend the deadbolt 124 without having the homeowner manually use a key or paddle.

The main housing 110 can also include electronic components disposed within the main housing 110, such as a circuit board, a processor, or an antenna. The door lock 100 can be a "smart" lock having a variety of functionality including computing devices having wireless communications capabilities that allow it to communicate with other computing devices. For example, a homeowner can have a user device, such as a smartphone, that can wirelessly communicate with electronic components in the main housing 110 via one of the Institute of Electrical and Electronics Engineers (IEEE) 802.11 standards, Bluetooth®, Zigbee, Z-Wave, or other wireless communication techniques. In some implementations, electronic components in the main housing 110 can access a network such as the Internet via the user device. In other implementations, a network may be accessed without the user device as an intermediary. Thus, door lock 100 and the homeowner's smartphone can exchange data amongst themselves. For example, the door lock 100 can provide data regarding the state of the door lock 100 to the smartphone so that the homeowner knows whether the deadbolt 124 is in a locked position or an unlocked position. The main housing 110 can also receive data from a smartphone via wireless communications, for example providing an instruction to transition the deadbolt 124 from a locked position to an unlocked position. The electronic components in main housing 110 can be powered by a power supply disposed within the deadbolt 124 in the bolt housing 120.

The main housing can have a substantially circular footprint and be configured to be disposed within a standard bore hole disposed within a door. For example, the main housing 110 can be configured to be disposed within an American National Standards Institute® (ANSI) deadbolt bore hole, which has a diameter of 2⅛ inches. In another example, a depth of the main housing 110 can be configured to fit within an ANSI standard door thickness, which is 1¾ inch. The main housing 110 can include openings 114 and 116. These openings can include a conductive portion and/or be configured to facilitate mechanical movement of a deadbolt. For example, as shown in FIG. 1, openings 114 are conductive openings. As shown in FIG. 1, opening 116 is configured to rotate to facilitate extension or retraction of a deadbolt 124.

The main housing 110 can be configured to engage with a bolt housing 120. The main housing 110 and bolt housing 120 can be engaged at a bolt carriage 118 of the main housing 110. For example, the bolt carriage 118 can include a female connector groove that connects to a male connector 122 of the bolt housing 120, as shown in FIG. 1. Connections between the main housing 110 and the bolt housing 120 may take any number of forms, including mechanical or electromagnetic connections. The main housing 110 can engage with the bolt housing 120 to cause a deadbolt 124 within the bolt housing 120 to move between a locked position and an unlocked position. For example, the locked position can include extending the deadbolt 124 into a wall, and the unlocked position can include retracting the deadbolt 124 into the bolt housing 120. As shown in FIG. 1, the deadbolt 124 is retracted in the bolt housing 120 in an unlocked position. The bolt housing 120 can further include a plate 126. The plate 126 can be attached to a door, for example using screws. The plate 126 can be multiple sizes or shapes to accommodate different doors. For example, the plate 126 can have different height, width, or depth to match a cutout in a door. In another example, the plate 126 can be rectangular and have either rounded or sharp corners.

The deadbolt 124 can be configured to receive a power supply. The power supply can include, for example, an electrochemical cell (e.g., a flow battery, ultrabattery, and/or rechargeable battery), a capacitor (e.g., a supercapacitor), an energy storage coil (e.g., a superconducting magnetic energy storage device), a compressed air energy storage device, a flywheel, a hydraulic accumulator, a chemical energy storage device (e.g., hydrogen storage), or any combination of energy storage devices. For example, the power supply can be a small battery, such as a lithium CR2 battery. The bolt housing 120 can be configured to receive power from the power supply. The main housing 110 can be electrically connected to the bolt housing 120. For example, the bolt carriage 118 of the main housing 110 and the male connector 122 of the bolt housing 120 can both include pins. Engaging the respective pins can then allow current to flow to the main housing 110 from the power supply within the bolt housing 120.

The bolt housing 120 can be extendable to accommodate bolt caps on the bolt of varying size. In particular, the bolt housing 120 may extend to accommodate a bolt cap with a length matching a standard bore hole, such as an ANSI standard bore hole with 2⅛ inch diameter and 2¾ inch backset.

The outer housing 130 can be disposed exterior of a door and face outside of a secure environment. For example, the outer housing can be disposed outside of a house or apartment. The outer housing can include a keyhole 132 configured to receive a key that can lock or unlock the deadbolt 124.

The outer housing 130 can include a set of prongs 134 and 136 to engage with the main housing 110. In the example shown in FIG. 1, the center prong 136 can engage with the opening 116 of the main housing 110. Rotation of the keyhole 132 can be coupled with rotation of the center prong 136, which causes rotation of the opening 116 of the main housing 110 and thereby facilitating movement of the deadbolt 124 between a locked position and an unlocked position.

The prongs 134 and 136 can be conductive to allow for electrical transmission between the outer housing 130 and the main housing 110. For example, as shown in FIG. 1, the prongs 134 are conductive prongs, while prong 136 is not conductive in this example. The conductive prongs 134 can engage with the conductive openings 114 of the main housing 110, allowing for electrical transmission between the main housing 110 and outer housing 130. As noted above, the main housing 110 can be electrically connected to the bolt housing 120, which can include a power supply within the deadbolt 124. Thus, current can flow from the power supply within the deadbolt 124 to the outer housing 130, powering any electrical components included in the outer housing 130. For example, a portion of the outer housing 130 can include a capacitive touch sensor 139 configured to detect a touch by a user. In another example, the outer housing can include a near-field communication (NFC) sensor configured to receive a signal from a card or mobile device.

The outer housing 130 can include a leakage region 138 that facilitates signal transmission through the outer housing. The leakage region 138 can allow for increased wireless transmission from an exterior of the outer housing 130 to a wireless communication component in the main housing 110. For example, a main housing 110 disposed within a metal door can receive a weaker wireless signal compared to a main housing 110 disposed within a wood door. In that case, an outer housing 130 including a leakage region 138 disposed on an exterior of the metal door can have higher transmission of the wireless signal received by the main housing 110 relative to an outer housing 130 without a leakage region. In some embodiments, the leakage region 138 can be composed of any material that allows wireless transmission though the material. For example, a leakage region 138 designed to allow transmission of a Bluetooth signal can be composed of plastic, glass, or silicone. In other embodiments, the leakage region 138 can include components that amplify a wireless signal, such as an antenna or a signal booster. As shown in the example in FIG. 1, the leakage region 138 is located on a perimeter of the outer housing 130. Also as shown in FIG. 1, the leakage region 138 is positioned to contact an exterior of a door, which can provide for increased security and aesthetics.

The inner housing 140 can be configured to protrude exterior of a door and face interior to a secure environment, such as inside a house. The inner housing 140 can engage with the main housing 110 and outer housing 130. As shown in the example in FIG. 1, the inner housing 140 can engage with the main housing 110 and outer housing 130 via the prongs 134 and 136. The inner housing 140 can include openings 144, which can be secured to the prongs 134 of the outer housing, for example, by a set of screws.

The inner housing can be attached to a rotating member 142 that causes the deadbolt 124 to transition between a locked position and an unlocked position. For example, rotation of the rotating member 142 clockwise can initiate mechanical movement of the deadbolt 124 from the unlocked position to the locked position. As shown in the example in FIG. 1, the rotating member 142 can include a paddle to assist a user in manual rotation of the rotating member 142. The rotating member 142 is not limited to a paddle, but can include any suitable hardware, such as a knob, lever, handle, button, etc. As shown in FIG. 1, the center prong 136 of the outer housing can extend through opening 116 of the main housing 110 into a notch 146 of the inner housing. Rotation of the rotating member 142 can cause the notch 146 to rotate, causing the opening 116 of the main housing 110 to rotate via the center prong 136, thereby causing the deadbolt 124 to transition between a locked position and an unlocked position. As discussed in more detail below, the rotating member can include a magnet with opposing polarity to another magnet on the inner housing, which allows for smooth rotation and an enhanced tactile experience for a user.

Figure 2:
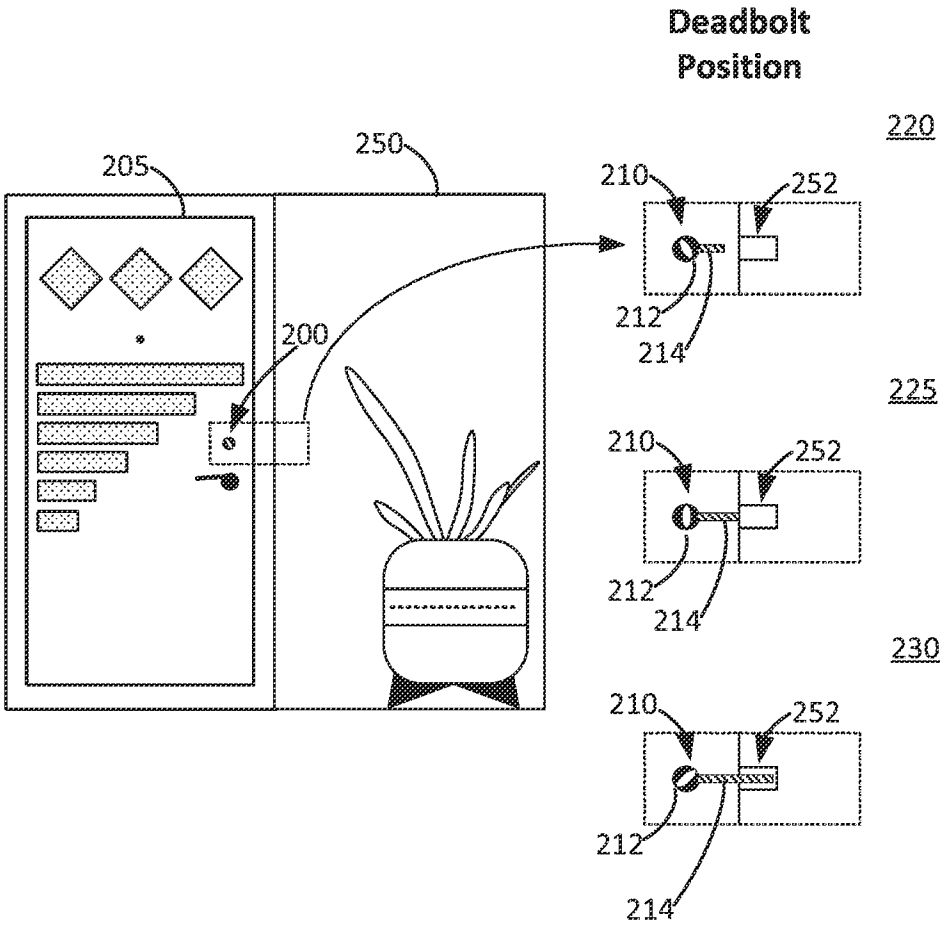
FIG. 2 shows an example door lock disposed within a door in various positions.

FIG. 2 shows an example door lock 200 disposed within a door 205. The door lock 200 can include a main housing 210 disposed within a bore hole of the door 205. As shown in FIG. 2, the door 205 is adjacent to a wall 250. A bore hole can be a cylindrical opening through a depth of the door 205. The diameter and depth of the bore hole can be a standard size, such as an ANSI standard bore hole with diameter 2⅛ inches and depth 1¾ inches. In addition, the bore hole can be in various positions on the door. For example, the bore hole can have a backset distance of 2¾ inches between the center of the bore hole and an edge of the door 205. In another example, the bore hole can have a backset distance of 2⅜ inches from the center of the bore hole and an edge of the door 205.

The door lock 200 can also include a deadbolt 214 within a bolt housing. The deadbolt 214 can extend or retract through a cross bore of the door. The cross bore can have varying shapes and/or sizes and be orthogonal to the bore hole. For example, the cross bore can be cylindrical with a diameter of 1 inch.

The door lock 200 can include a paddle 212. A homeowner can rotate the paddle 212 to cause the deadbolt 214 to retract into a bolt housing of door lock 200 or to cause the deadbolt 214 to extend into a slot 252 of the wall 250. For example, a homeowner inside a house can rotate the paddle 212 clockwise to extend the deadbolt 214 into the slot 252 of the wall and lock the door 205. The homeowner can rotate the paddle 212 counterclockwise to retract the deadbolt 214 into a bolt housing and lock the door 205. Conversely, a homeowner can cause the deadbolt 214 to transition between a locked position and an unlocked position by other means, such as with a key or by a wireless communication to actuate the main housing 210, in order to cause the paddle to rotate. Although FIG. 2 displays a paddle 212, other suitable hardware such as a lever, handle, or knob can be used.

FIG. 2 shows three example positions for a door lock. In an unlocked position 220, the deadbolt 214 is retracted to allow the door to open and close freely. In a transitional position 225, the deadbolt 214 is partially extended but does not reach the slot 252 of the wall 250. In a locked position 230, the deadbolt 214 is extended into the slot 252 of the wall 250, preventing the door 205 from being opened. In each of the positions 220, 225, and 230, the paddle 212 can rotate, indicating to a homeowner the position of the deadbolt.

Outer Housing

Figure 3A:
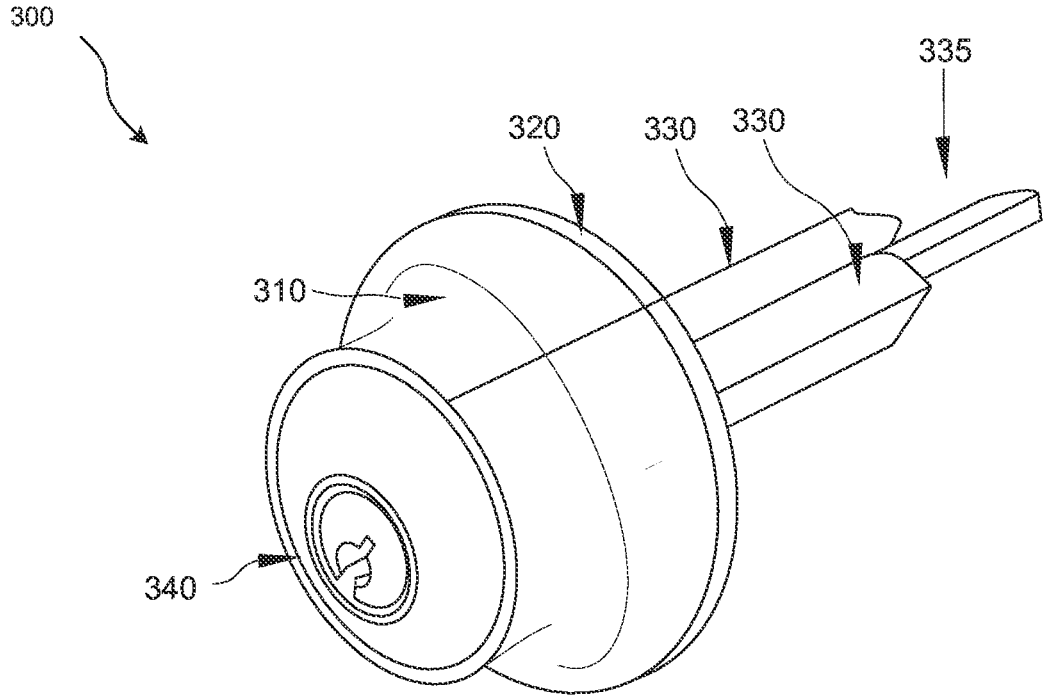
FIG. 3A shows an example outer housing of the door lock.

FIG. 3A shows an example outer housing 300 of the door lock. The outer housing may protrude exterior of a door facing exterior of a secure environment, such as outside of a house. The outer housing 300 can be mechanically and electrically connected to the main housing and the inner housing via prongs 330 and 335. The prongs can extend through openings in the main housing to engage with an inner housing interior of the secure environment. The prongs 330 can be conductive prongs to allow for electrical transmission between the outer housing 300 and the main housing. In the example as shown in FIG. 3A, the center prong 335 can be coupled with the keyhole 340 to rotate as a user rotates a key within the keyhole 340. This rotation can be coupled with the main housing to facilitate a transition of the deadbolt between a locked and an unlocked position.

Outer housing 300 can include circuitry and other hardware to provide capacitive touch sensing and nearfield communication (NFC) to allow techniques to provide an instruction to lock or unlock. The circuitry of outer housing 300 can be powered by tapping into a power supply disposed within a deadbolt. The battery can be tapped via conducting prongs 330 such that the battery can power the circuitry and components housed within the outer housing 300. In some implementations, outer housing 300 can also include another battery and conducting prongs 330 can be used to provide charge from that battery to components housed within the main housing.

In some implementations, outer housing 300 can include capacitive touch capabilities to lock or unlock the door. For example, a capacitive touch sense circuit can be installed on a flex or printed circuit board (PCB) within outer housing 300 to determine that a human finger has touched outer housing 300. If a human finger is detected, then the door can be unlocked (e.g., the deadbolt can be retracted) or locked (e.g, the deadbolt can be extended). In some implementations, the fingerprint of the finger can be detected and imaged, and if that imaged fingerprint is determined to be an authorized fingerprint (e.g., of the homeowner who previously registered his or her fingerprints) then the door can be unlocked. As shown in FIG. 3A, the outer housing 300 includes a capacitive touch portion 310.

In one example of detecting touch to lock or unlock a door, a homeowner can swipe, or move a finger, along the capacitive touch portion 310 to lock or unlock the door by adjusting the position of the deadbolt along a linear path in response to the movement of the finger. For example, a user can swipe their finger in a clockwise direction along the capacitive touch portion 310 to extend the deadbolt and lock the door, and swipe their finger in a counterclockwise direction along the capacitive touch portion 310 to unlock the door. In another example, the deadbolt can fully retract or extend in response to a tap of a finger.

The door may also unlock or lock in response to the door lock detecting a wireless communication signal. For example, the door may only unlock upon activation of the capacitive touch portion 310 if the door lock also receives a wireless communication signal from an authorized user device. The wireless communication signal can be any electromagnetic transfer of information, such as radio, GPS, Bluetooth, Wi-Fi, near-field communication (NFC), 4G, 5G, etc. The wireless communication signal may be detected by a wireless communication component in the main housing or in the outer housing 300. For example, the outer housing 300 can include an NFC sensor so that a user can transmit a signal to the door lock from a smartphone or NFC card. In another example, the main housing can include an antenna configured to receive a Bluetooth signal transmitted from a user's smartphone.

The deadbolt may also transition between a locked position and an unlocked position in response to both detecting a wireless communication signal and detecting a touch on the capacitive touch portion 310. That is, rather than locking or unlocking the door in response to either detection individually, the door may lock or unlock in response to the door lock detecting both the wireless communication signal and the touch within a short time frame. For example, a homeowner can bring their paired smartphone into a Bluetooth communication range of the door lock and proceed to touch the capacitive touch portion 310, causing the deadbolt to transition to an unlocked position. In that case, the door unlocks after the door lock detects the wireless communication signal and the touch on the capacitive touch portion 310. In another example, a trespasser can touch the capacitive touch portion 310 but not have a smartphone paired with the door lock via Bluetooth. In that case, the door lock would not detect the wireless communication signal, and the door would not unlock, even if the door lock detects a touch on the capacitive touch portion 310.

The outer housing 300 can include a leakage region 320 to facilitate wireless signal transmission through the outer housing into the main housing. For example, a main housing disposed within a metal door can have difficulty receiving certain wireless signal frequencies compared to a main housing disposed within a wood door. The leakage region 320 can provide a path that allows for improved signal transmission into the door lock. The leakage region 320 can be composed of any material that allows for transmission of a desired wireless signal frequency. For example, a leakage region 320 designed to allow transmission of a Bluetooth signal can be composed of plastic, glass, or silicone. In other embodiments, the leakage region can include components that amplify a wireless signal, such as an antenna or a signal booster.

The leakage region 320 can be positioned anywhere on the outer housing 300 to allow for a path to facilitate wireless signal transmission. In the example as shown in FIG. 3A, the leakage region can be positioned along a perimeter of the outer housing 300. Also shown in FIG. 3A, the leakage region can also be positioned against the door, underneath exterior portion of the outer housing 300. This positioning of leakage region 320 allows for improved aesthetics and security, as it allows the outer housing 300 to be more substantially made of metal. In other embodiments, the leakage region 320 could be positioned surrounding the keyhole 340.

Figure 3B:
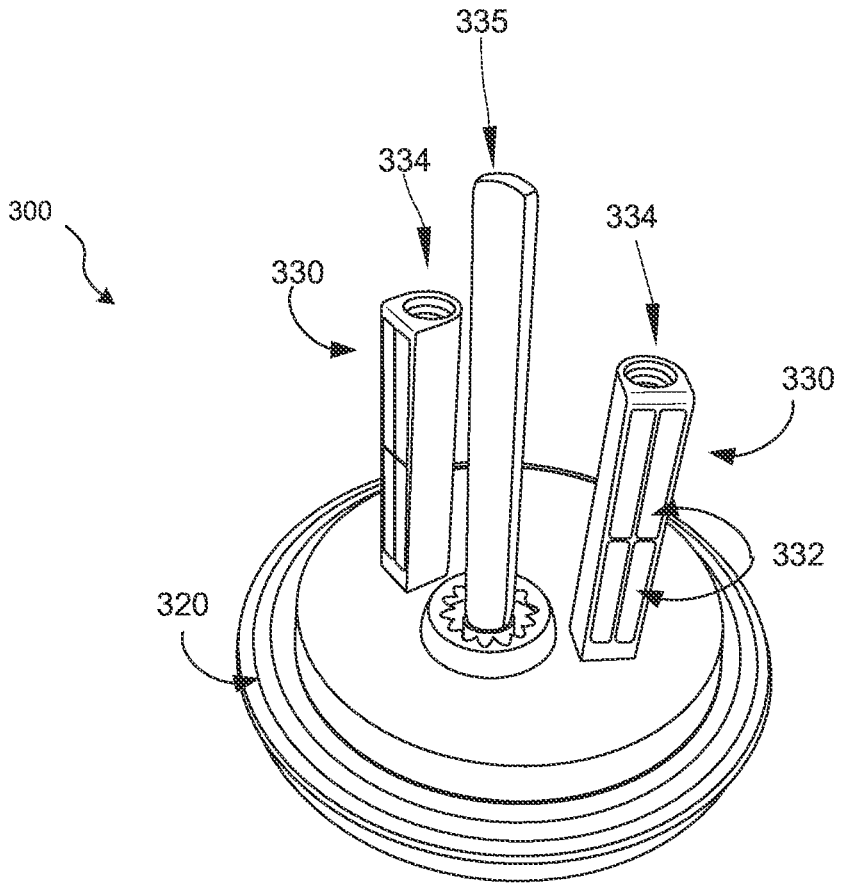
FIG. 3B shows a rear view of an example outer housing of the door lock.

FIG. 3B shows a rear view of an example outer housing 300. Outer housing 300 includes a center prong 335, which can extend through an opening of the main housing configured to rotate and facilitate a transition of a deadbolt between a locked position and an unlocked position. As shown in FIG. 3B, center prong 335 is configured to rotate. The rotation of the center prong 335 can be coupled with the rotation of the opening of the main housing to cause the deadbolt to transition between a locked position and an unlocked position. Furthermore, the center prong 335 can engage with a rotating member of the inner housing so that rotation of the rotating member of the inner housing will also cause the deadbolt to extend or retract.

Conductive prongs 330 can extend through conductive openings in the main housing to engage with the inner housing. The electrical connection to the main housing can be established by the conductive pins 332 on the conductive prongs 330 when the conductive pins contact a conductive opening of the main housing. Electrically connecting the main housing to the outer housing 300 using conductive prongs 330 makes it easier for a homeowner to install the door lock on the door by reducing the need for wiring, which can easily become disconnected or pinched against the door during installation.

The conductive prongs 330 can be extended through the main housing to engage with the inner housing. For example, as shown in FIG. 3B, the conductive prongs 330 include screw holes 334. The inner housing can be screwed directly onto the screw holes 334 using a set of screws. This further simplifies installation by using the conducting prongs 330 to electrically and mechanically connect the outer housing 300, the inner housing, and the main housing. Besides screws, the outer housing 300 can engage with the inner housing by any suitable attachment mechanism, such as nails, rivets, adhesive, magnets, etc.

As shown in FIG. 3B, the leakage region 320 can be positioned on a perimeter of the outer housing 300. The leakage region 320 can contact the door to provide improved aesthetics and security. For example, positioning the leakage region against the door allows for the portions of the outer housing facing the exterior of a secure environment, such as a house, to be metal, which is a more secure material against physical tampering but can inhibit transmission of wireless signals through the outer housing 300. Furthermore, positioning the leakage region against a door can reduce scratches or other physical damage to the door during installation of the door lock.

Inner Housing

Figure 4A:
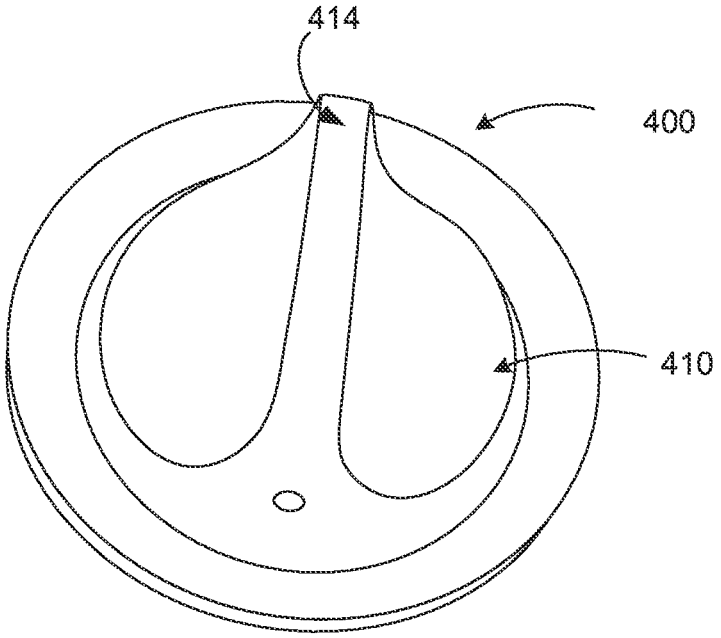
FIG. 4A shows an example inner housing of the door lock.

FIG. 4A shows an example inner housing 400 and rotating member 410. The inner housing 400 can protrude from the door facing interior of a secure environment, such as a home or business. The rotating member 410 can be engaged to the inner housing and facilitate transitioning of the deadbolt between a locked position and an unlocked position. The rotating member 410 can include a paddle 414 to allow a user to manually rotate the rotating member 410.

In many cases, springs may be used to indicate specific rotation points of a rotating member. However, using springs may result in varying friction between the rotating member and inner housing in rotating the rotating member. For example, springs may increase friction such that mechanical components of the locking mechanism may be unable to overcome the friction in extending the deadbolt. This may result in the deadbolt being unable to extend or retract due to the friction provided by the springs.

Figure 4B:
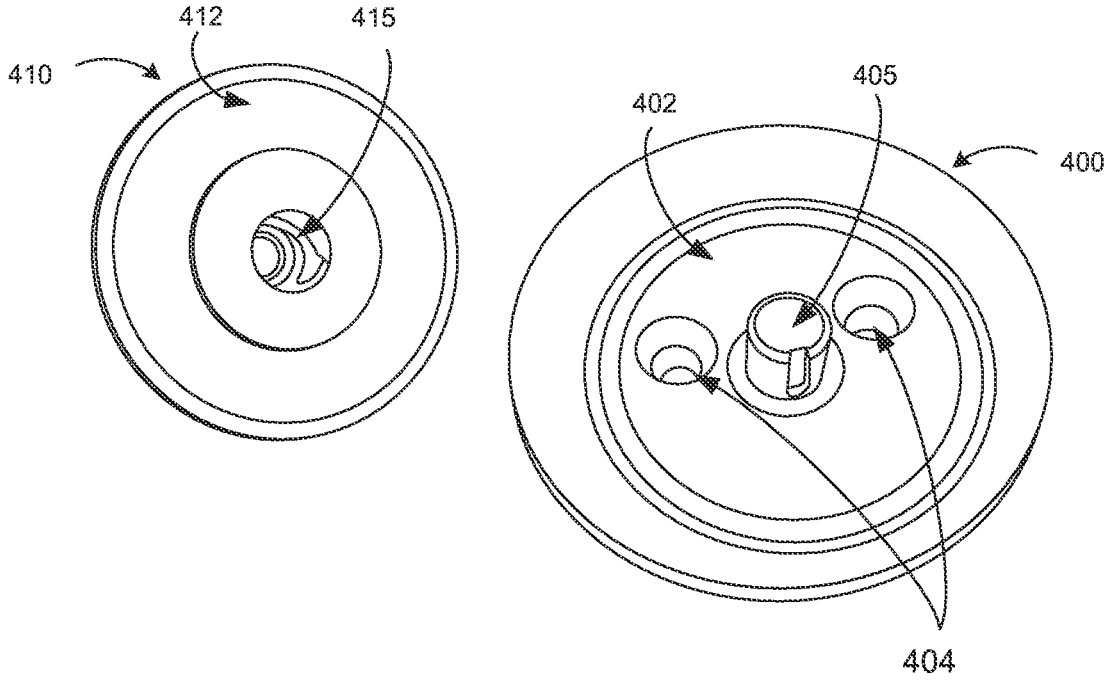
FIG. 4B shows an example inner housing and rotating member of the door lock.

Accordingly, FIG. 4B shows a view of the example inner housing 400 separate from the rotating member 410. The inner housing can include a first magnet 402 with a first polarity, and the rotating member 410 can include a second magnet 412 with a second polarity. As shown in FIG. 4B, the magnets 402 and 412 can be ring magnets. The magnets can be disposed adjacent to each other when the inner housing 400 and rotating member 410 are engaged as shown in FIG. 4A. Adjusting the relative strength of the magnets 402 and 412 can adjust the force needed to rotate the rotating member 410.

In addition, adjacent magnets will experience a torque to align their magnetic fields. Since the magnets 402 and 412 can be configured to have multiple poles, the magnets 402 and 412 can be configured such that the inner housing 400 and the rotating member 410 will tend to magnetically align at desired orientations. This effect can thus be used to "index" the relative orientations of the inner housing 400 and rotating member 410. For example, if the magnets 402 and 412 have 8 poles each, then the rotating member will experience a magnetic force toward an orientation every 45 degrees of rotation. These orientations at 0 degrees, 45 degrees, 90 degrees, etc. can be considered "indexed." Further, by using magnets instead of springs or other mechanical means, friction between the rotating member and the inner housing is reduced, increasing efficiency in mechanically moving the deadbolt between the locked and unlocked position.

As shown in FIG. 4B, the inner housing 400 includes openings 404 and a fitting 405. The fitting 405 can be configured to rotate. The openings 404 can engage with the conductive prongs 330 of the outer housing 300. The inner housing 400 can then be secured to the conductive prongs 330, for example with screws, nails, rivets, adhesive, or any other suitable attachment mechanism. The rotating member 410 can include a notch 415 to receive fitting 405 of the inner housing 400 and assist in rotation of the fitting 405. For example, the rotating member can be rotated by the paddle 414, causing the fitting 405 to rotate. The fitting 405 can be configured to receive center prong 335, which can extend through a rotating opening of the main housing. Thus, the rotation of rotating member 410, the fitting 405 of the inner housing 400, the center prong 335 of the outer housing 300, and the opening of the main housing can be coupled to each other, so that the rotation of the rotating member 410 can be coupled to the position of the deadbolt.

Main Housing

Figure 5:
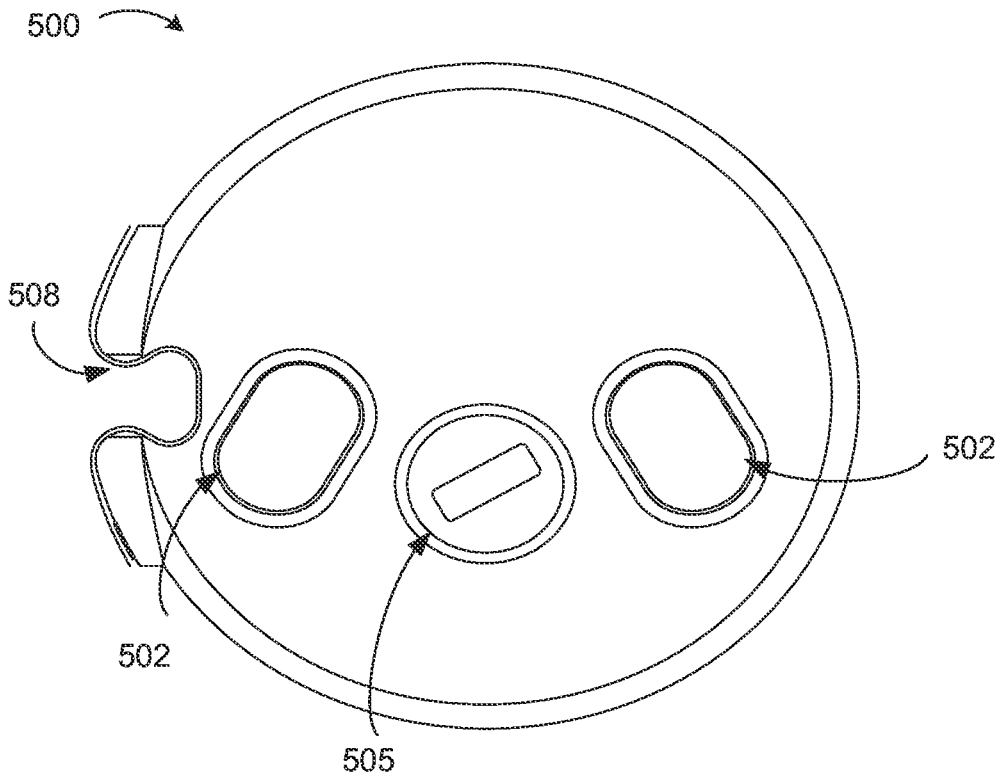
FIG. 5 shows an example main housing of the door lock.

FIG. 5 shows an example main housing 500. The main housing 500 can be configured to be disposed within a bore hole of a door. For example, the main housing 500 can be configured to be disposed within an American National Standards Institute® (ANSI) deadbolt bore hole, which has a diameter of 2⅛ inches. In another example, a depth of the main housing 500 can be configured to fit within an ANSI standard door thickness, which is 1¾ inch.

The main housing 500 can include conductive openings 502 and a bolt carriage 508. The bolt carriage 508 can engage the bolt housing and draw electricity from a power supply disposed within a deadbolt carried in the bolt housing. The conductive prongs 330 of outer housing 300 can extend through the conductive opening 502 to establish an electrical connection between the outer housing 300 and the main housing 500. Thus, the electricity from the power supply disposed within the deadbolt can power electronic components within the main housing 500 as well as other electronic components disposed within the outer housing 300. As shown in FIG. 5, the bolt carriage 508 can include a female connector groove that engages with a male connector of the bolt housing. The bolt carriage 508 can include pins to allow for the transmission of electricity between the bolt housing and the main housing 500.

The main housing 500 can include an opening 505 configured to rotate and cause a deadbolt to transition between a locked position and an unlocked position. The main housing can include actuating components such as an actuator, gear drive, lock gearbox, latch mechanisms, motor, etc. The actuating components can include any components that can assist in mechanically moving the deadbolt. The bolt carriage 508 can be mechanically connected to the deadbolt by the female connector groove, in addition to the electrical connection as described above. Rotation of the opening 505 can cause some of these actuating components to move the bolt carriage 508, which then results in movement of the deadbolt. For example, a homeowner could turn a paddle coupled to the opening 505 to move the deadbolt. Some of these actuating components can be powered by a power supply, for example a battery disposed within the deadbolt. Transmitting electrical energy to the actuating components can cause the actuating components to move the deadbolt. This can allow for the main housing 500 to move the deadbolt without mechanical force from a user, such as by turning a key or paddle.

The main housing 500 can include electronic components, such as circuit boards, processors, and antennas, for example Bluetooth, Wi-Fi, or 5G antennas. These electronic components can be powered by any suitable power supply, for example, by a battery disposed within the deadbolt.

In some embodiments, a controller circuit (e.g., a processor) within the main housing 500 can receive an instruction via wireless communication from a mobile device (e.g., mobile phone, smart watch, electronic ring, tablet, etc.) indicative of a lock or unlock request. An antenna within the main housing 500 can relay the instruction to the controller circuit. In addition, the processor can receive a signal from the outer housing 300, such as a signal from a capacitive touch sensor in the outer housing 300, or an NFC signal. The signal from the outer housing 300 can be transmitted to the controller circuit through conductor prongs 330 of the outer housing 300. The controller circuit can cause the actuator to extend or retract.

In some embodiments, the controller circuit can receive a gravity vector determined by an accelerometer as it rotates along the non-linear path. The controller circuit can determine a position of the deadbolt along the linear path based on the gravity vector. The controller circuit can determine that the position of the deadbolt along the linear path corresponds to an endpoint of the non-linear path of the accelerometer. The controller circuit can cause the actuator to stop extending the deadbolt based on the determination that the position of the deadbolt along the linear path corresponds to the endpoint of the non-linear path of the accelerometer. The controller circuit can transmit a message indicating a lock state (e.g., locked, unlocked, partially locked, 30% extended, 90% extended, etc.) via the antenna. The message can be transmitted to another device (e.g., a mobile device) directly (e.g., via a personal area network) or indirectly (e.g., via a router configured to relay the message).

Extendable Bolt Housing

Doors can have bore holes of various sizes and placements on the door. For example, an ANSI standard bore hole size can be 2⅛ inches. An ANSI standard backset distance between the center of the bore hole and the edge of the door can be 2⅜ inches or 2¾ inches. In addition, doors can have bore holes of non-standard sizes and backsets. This variation can result in a door lock having unsuitable dimensions for installation on a specific door.

Figure 6A:
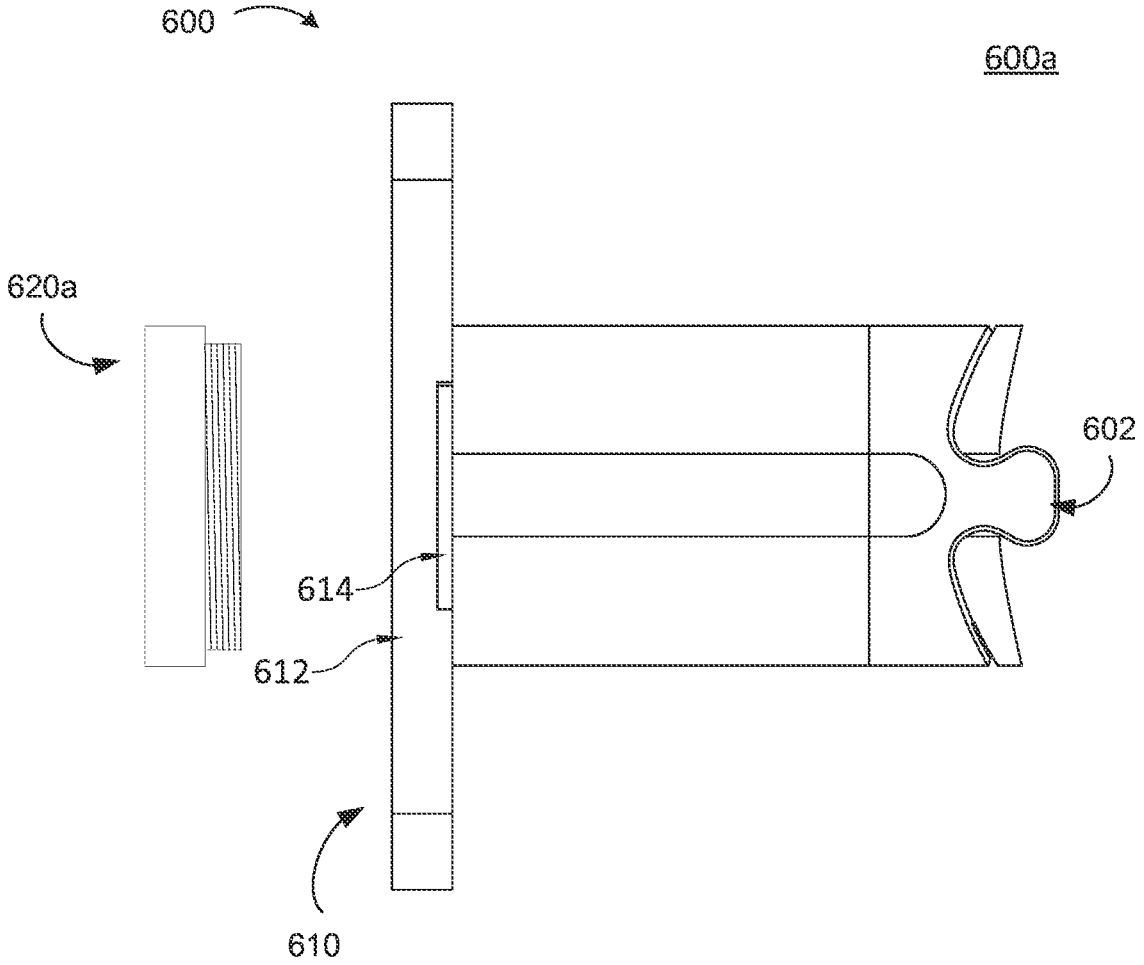
FIG. 6A shows an example bolt housing of the door lock in a default position.

FIG. 6A shows an example bolt housing 600 in a default position 600*a*. The length of the bolt housing 600 in default position 600*a* can be configured to accommodate a desired backset distance. For example, the default position 600*a* can accommodate a backset distance of 2⅜ inches. The bolt housing 600 can include a male connector 602, a plate 610, and a first bolt cap 620*a*. The bolt housing 600 can be configured to surround a deadbolt. The male connector 602 can engage with a female groove connector on the main housing 500 to electrically and mechanically connect the bolt housing 600 to the main housing 500. The plate 610 can include a front plate 612 and a back plate 614. The plate 610 can be affixed to an edge of a door, for example by a set of screws or nails.

The first bolt cap 620*a* can be configured to engage a deadbolt to a battery within the deadbolt and allow for electrical transmission from the battery to the bolt housing 600 and other parts of the door lock, including the main housing 500, outer housing 300, and inner housing 400. The length of the first bolt cap 620*a* can be configured to accommodate a desired backset distance. For example, the length of the first bolt cap 620*a* can accommodate a backset distance of 2⅜ inches without protruding past the edge of the plate 610 or being recessed into the bolt housing 600.

Figure 6B:
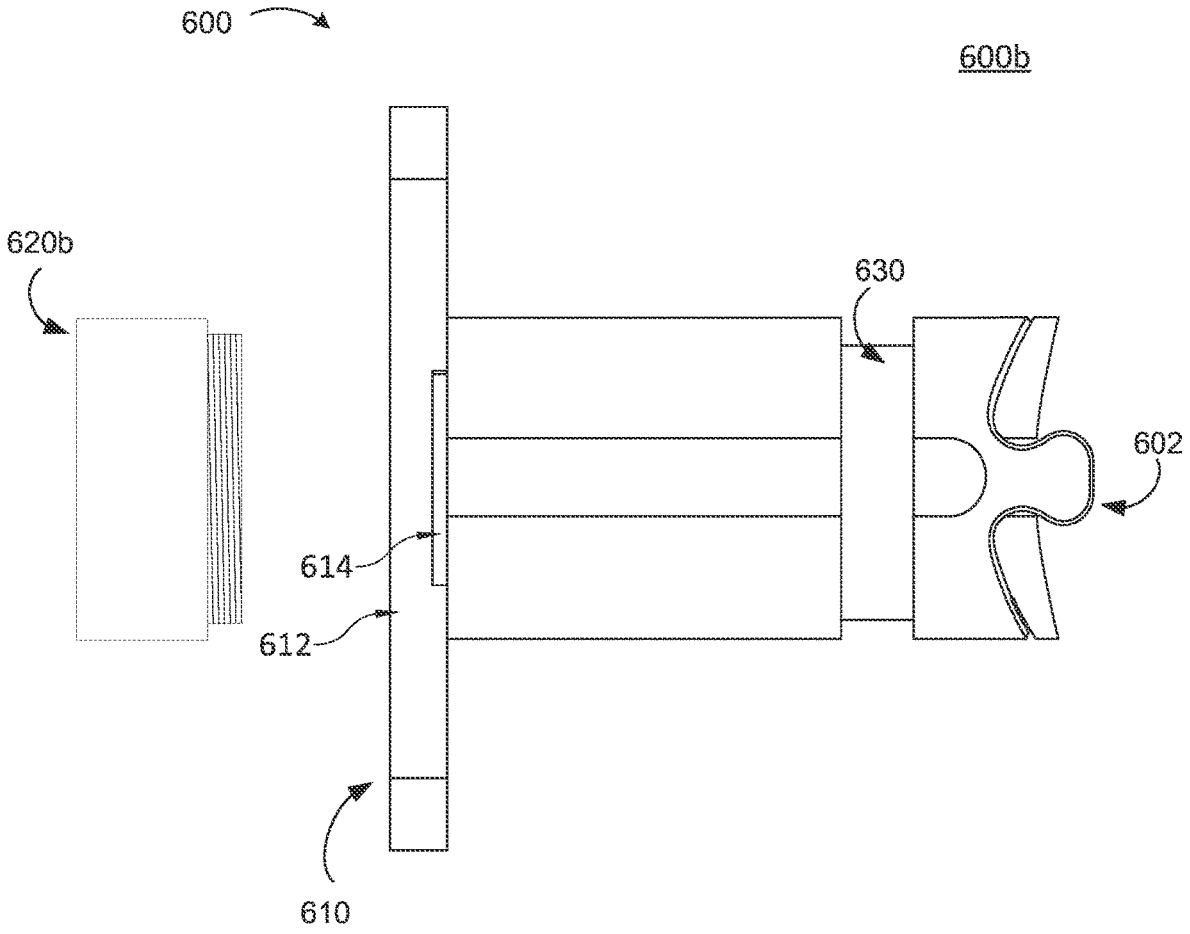
FIG. 6B shows an example bolt housing of the door lock in an extended position.

FIG. 6B shows an example bolt housing 600 in an extended position 600*b*. The bolt housing 600 includes a bolt sleeve 630 that allows the bolt housing 600 to vary in length. This allows the bolt housing 600 to accommodate different length backset distances. For example, the bolt housing 600 in extended position 600*b* can accommodate a backset distance of 2¾ inches. The bolt housing 600 can transition between the default position 600*a* and the extended position 600*b* and thus accommodate multiple bore hole sizes and/or backsets.

As shown in FIG. 6B, a second bolt cap 620*b* can be used when the bolt housing 600 is in extended position 600*b*. The length of the second bolt cap 620*b* can be different than that of the first bolt cap 620*a* to accommodate a change in length when the bolt housing 600 changes position. For example, the default position 600*a* can accommodate a backset of 2⅜ inches, while the extended position 600*b* can accommodate a backset of 2¾ inches. In this example, the second bolt cap 620*b* can be ⅜ inches longer than the first bolt cap 620*a*. The bolt caps 620*a* and 620*b* can be replaced with each other as needed to accommodate different bore hole sizes and backsets. Note that the bolt housing 600 and bolt caps 620*a* and 620*b* can be configured to accommodate any bore hole sizes and backset distances and should not be limited to the lengths described in the examples. Similarly, the bolt housing can be configured to have any number of positions, not just the default position 600*a* and extended position 600*b* as shown.

Figure 7:
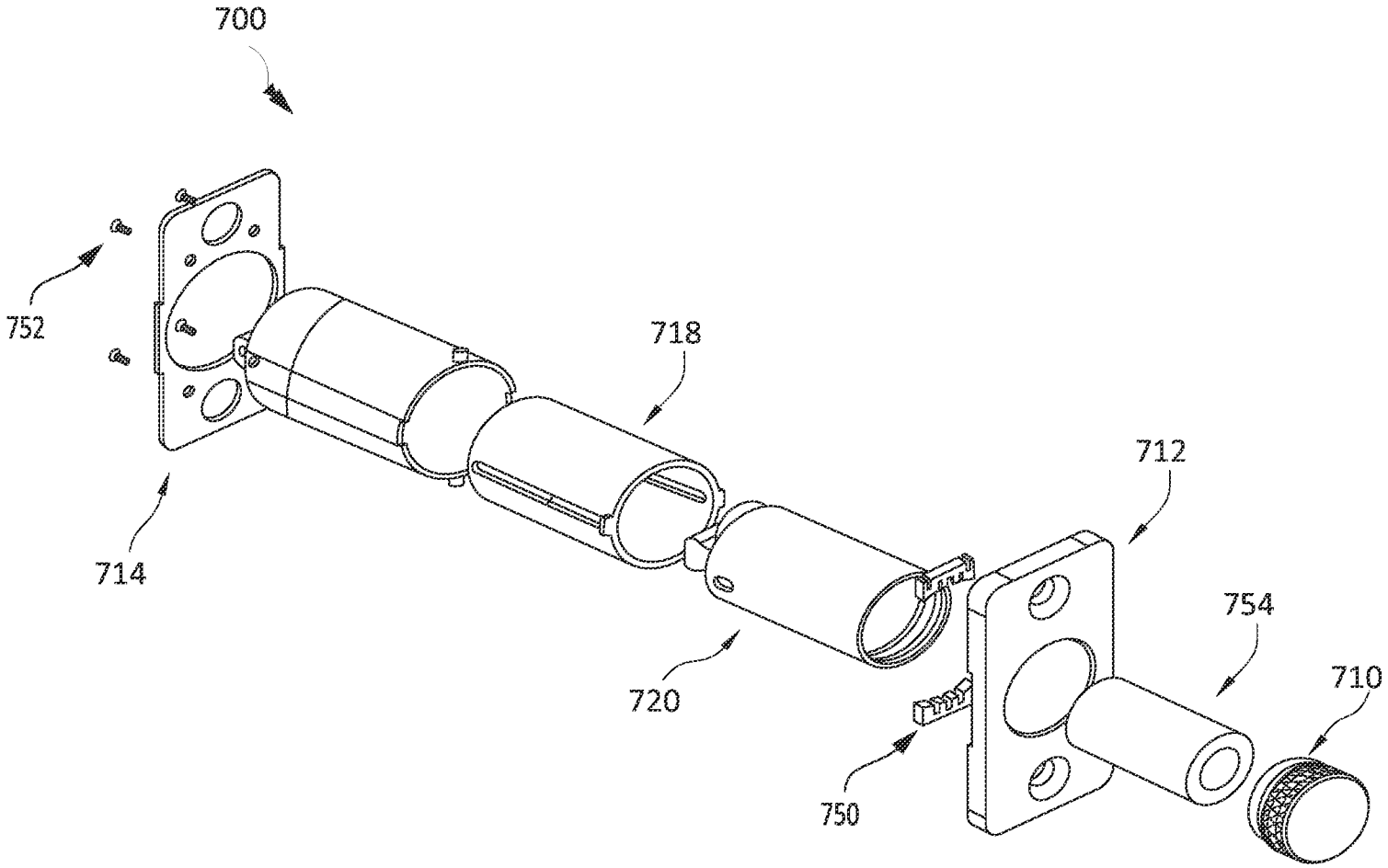
FIG. 7 shows an exploded view of an example bolt housing of the door lock.

FIG. 7 shows an exploded view of an example bolt housing 700 and deadbolt 720. The bolt housing 700 can be configured to receive a deadbolt. For example, the deadbolt 720 can rest within a bolt sleeve 718 within the bolt housing 700. The deadbolt 720 can extend out of the bolt sleeve 718 and the bolt housing 700 upon being positioned to a locked position. The deadbolt 720 can be retracted into the bolt sleeve 718 and the bolt housing 700 upon being positioned to an unlock state.

The deadbolt 720 can be approximately cylindrically shaped. The deadbolt 720 can include a hollow inner region configured to receive a power supply 754. The energy storage device can include, for example, an electrochemical cell (e.g., a flow battery, ultrabattery, and/or rechargeable battery), a capacitor (e.g., a supercapacitor), an energy storage coil (e.g., a superconducting magnetic energy storage device), a compressed air energy storage device, a flywheel, a hydraulic accumulator, a chemical energy storage device (e.g., hydrogen storage), or any combination of energy storage devices. The power supply 754 can be approximately cylindrically shaped. For example, the power supply 754 can be a lithium CR2 battery.

The deadbolt 720 can be composed of a hardened material such as, for example, a nitride metal, a precipitation hardened alloy, or a combination thereof. The hardened material (e.g., steel or stainless) can be case-hardened or through hardened to increase the surface hardness of the deadbolt 720 and/or the strength of the deadbolt 720. This can be accomplished via nitriding, carburization, precipitation hardening, other tempering applications, a combination of tempering applications. Despite the use of less material for the deadbolt 720 (e.g., due to the hollow inner region), the hardened material can enable the deadbolt 720 to have an approximately equal fracture strength as a conventional deadbolt. Thus, the deadbolt 720 can provide space for an energy storage device while maintaining structural integrity.

A back plate 714 can be attached to a front plate by an attachment mechanism (e.g., plate screws 752). A plate hinge 750 between the back plate 714 and the front plate 712 can allow the back and front plates 714, 712 to tilt independently of the bolt housing 700 over a range of angles while being attached to the bolt housing 700. Enabling the back and front plates 714, 712 via the plate hinge 750 can allow the back plate 714 to rest against a door having an uneven surface.

The bolt cap 710 can be attachable to the deadbolt 720. For example, the bolt cap 710 can be screwed into the deadbolt 720 via threading on the interior of the deadbolt 720. As described above and shown in FIGS. 6A and 6B, the bolt cap 710 can be of varying sizes to accommodate different bore hole dimensions and backsets. The bolt cap 710 can secure a power supply 754 within the deadbolt 720. In some embodiments, the bolt cap 710 can be electrically connected to the power supply 754 to allow electrical transmission from the power supply 754 to other parts of the door lock. For example, the bolt cap can contact a negative terminal of a cylindrical battery within the bolt housing 700 while the positive terminal of the battery contacts another portion of the bolt housing 700. The bolt cap 710 can be electrically connected to the bolt housing 700, thus allowing current to flow from the battery.

Methods to Lock and Unlock a Door

Figure 8:
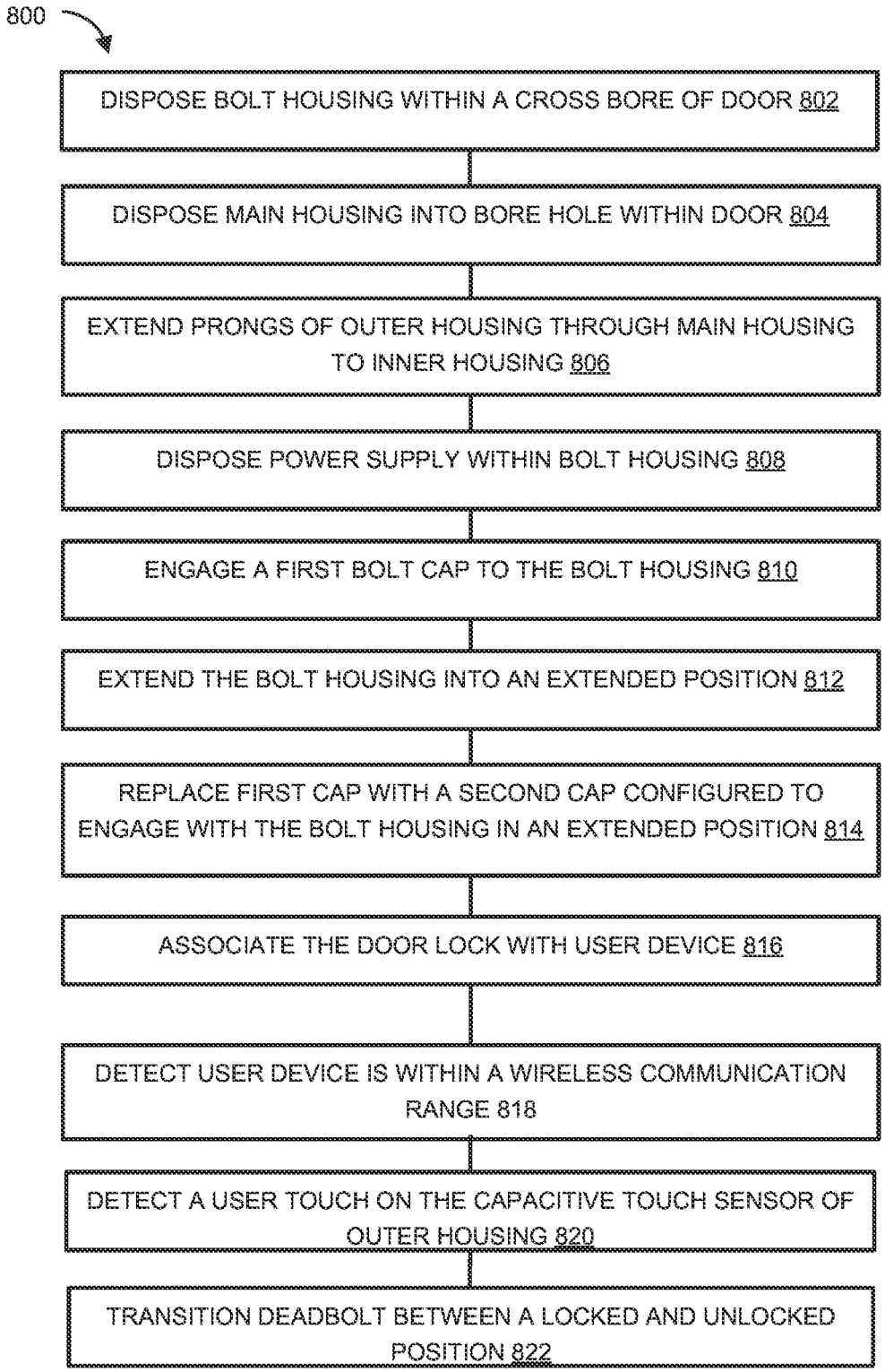
FIG. 8 shows an example method for moving a deadbolt of a door lock between a locked position and an unlocked position.

FIG. 8 shows an example method 800 for transitioning a deadbolt of a door lock between a locked position and an unlocked position. At least some of the present embodiments can relate to disposing components of a locking mechanism in a door. The method can include disposing a bolt housing within a cross bore of a door (802). For example, the cross bore can be an ANSI standard bore with 1 inch diameter. The method can include disposing a main housing into a bore hole disposed within a door (804). For example, the bore hole can be an ANSI standard bore hole with diameter 2⅛ inches, and the door can have an ANSI standard depth of 1¾ inches. The bore hole can be positioned at different backset distances, for example 2⅜ inches or 2¾ inches. The method can include extending prongs of an outer housing through openings of a main housing to an inner housing (806). The prongs of the outer housing can be conducting prongs and/or be configured to rotate. For example, the outer housing can include a keyhole configured to rotate a prong upon rotation of the keyhole. The openings of the main housing can be conductive openings and/or be configured to rotate and facilitate a transition of a deadbolt from a locked position or an unlocked position.

At least some of the present embodiments can relate to extending a bolt housing and accommodating caps for the bolt that include varying sizes. The method can include disposing a power supply within a bolt housing (808). The power supply can be, for example, a battery, such as a lithium CR2 battery. The method can include engaging a first bolt cap to the bolt housing (810). The first bolt cap can be configured to secure the power supply within the bolt housing. The first bolt cap can also be configured to allow for electrical transmission from the power supply to other parts of the door lock. The method can include extending the bolt housing into an extended position (812). Extending the bolt housing into an extended position can be used to accommodate a bore hole size or a backset. The method can include replacing the first bolt cap with a second bolt cap configured to engage with the bolt housing in an extended position (814). The second bolt cap can also be configured to secure the power supply within the bolt housing and/or allow for electrical transmission from the power supply to other parts of the door lock. The second bolt cap can have different dimensions from the first bolt cap. For example, the second bolt cap can be ⅜ inches longer than the first bolt cap.

At least some of the present embodiments can relate to transitioning a deadbolt between a locked and unlocked position based on receipt of an input. The method can include associating a door lock with a user device (816). The user device can be a smartphone, computer, tablet, NFC card, smart watch, or any other suitable device. The method can include detecting a user device is within a wireless communication range (818). For example, a wireless communication component in the main housing or in the outer housing can detect whether a user device is within a wireless communication range when an appropriate signal is received. The wireless communication range can span any suitable distance. For example, an NFC signal has a range on the order of centimeters. In another example, a Bluetooth signal has a range on the order of hundreds of meters. Other communications signals can have longer ranges, such as kilometers.

The method can include detecting whether a user touches a capacitive touch sensor of the outer housing (820). For example, the mutual coupling between row and column electrodes can be determined to have been changed which can signify a presence of touch, or the parasitic capacitance can be changed. In some implementations, the change in the capacitance can be determined to be within a threshold capacitance range that can be correlated with a human finger (e.g., human skin).

The method can include transitioning a deadbolt between a locked position and an unlocked position (822). This can occur in response to detecting a touch on the capacitive touch sensor (820), in response to detecting a user device within a wireless communication range (818), or in response to both 818 and 820. Alternatively, the step can be performed without detecting a touch (820) or detecting a user device within a wireless communication range (818).

In addition to detecting a touch, characteristics of a finger touching the capacitive touch sensor can be determined. For example, the movement of the finger upon the capacitive touch sensor along a circular path can be determined. Based on the characteristics, the deadbolt can be transitioned between a locked position and an unlocked position (822), for instance by extending and retracting the deadbolt. For example, the deadbolt can be extended or retracted to adjust the position of deadbolt along a linear path as a touch is detected to move in a clockwise or counterclockwise direction, respectively. Thus, touch sensor circuitry of the door lock can be configured to determine presence of a finger upon the capacitive touch sensor, and determine characteristics of the finger upon the determination of the presence of the finger upon the capacitive touch sensor. A controller circuit can then operate the motor of the door lock to retract or extend the deadbolt based on the characteristics of the finger.

In addition, other characteristics can be used. For example, merely the touch of a finger can be determined. In another example, a fingerprint reader can be implemented within the door lock and a person can place a finger upon the capacitive touch sensor to lock or unlock the door based on the fingerprint of the finger being recognized as an authorized fingerprint. In some implementations, a door can be locked by any fingerprint, but unlocked upon an authorized fingerprint. This can allow for a guest in the home to lock the door, but prevents the door from being unknowingly unlocked for the homeowner.

In another implementation, force or pressure sensitive sensors can be used to determine an amount of force or pressure applied to the outer housing. The characteristics of the finger can further be based on the amount of force or pressure applied. For example, a certain amount of pressure can be applied and the increase in amount of pressure can result in the deadbolt extending to lock the door.

Figure 9:
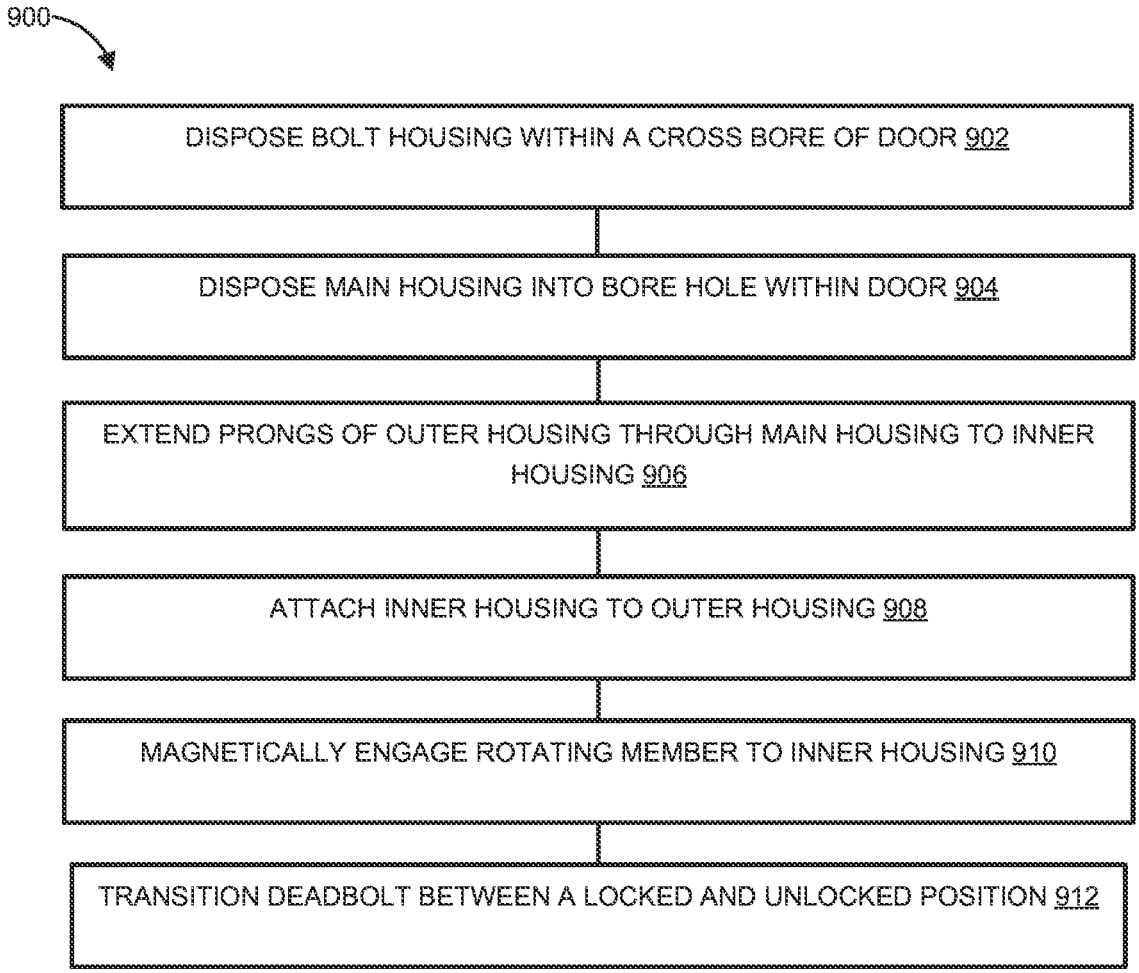
FIG. 9 shows an example method for moving a deadbolt of a door lock between a locked position and an unlocked position.

FIG. 9 shows an example method 900 for transitioning a deadbolt between a locked position and an unlocked position. The method can include disposing a bolt housing within a cross bore of a door (902). For example, the cross bore can be an ANSI standard bore with 1 inch diameter. The method can include disposing a main housing into a bore hole disposed within a door (904). For example, the bore hole can be an ANSI standard bore hole with diameter 2⅛ inches, and the door can have an ANSI standard depth of 1¾ inches. The bore hole can be positioned at different backset distances, for example 2⅜ inches or 2¾ inches. The method can include extending prongs of an outer housing through openings of a main housing to an inner housing (906). The prongs of the outer housing can be conducting prongs and/or be configured to rotate. For example, the outer housing can include a keyhole configured to rotate a prong upon rotation of the keyhole. The openings of the main housing can be conductive openings and/or be configured to rotate and facilitate a transition of a deadbolt from a locked position or an unlocked position.

The method can include attaching an inner housing to the outer housing (908). For instance, the inner housing can be attached to the prongs of the outer housing by screws. This allows for the inner housing and the outer housing to be secured against both sides of a door. The method can include magnetically engaging a rotating member to the inner housing (910). The rotating member can be configured to rotate and facilitate transition of a deadbolt from a locked position and an unlocked position as it rotates. The rotating member can include a paddle, knob, lever, or other mechanism to assist a user in rotating the rotating member. The inner housing and the rotating member can each include a magnet, such as a ring magnet. The two magnets can be disposed adjacent to each other, magnetically engaging the rotating member to the inner housing. The magnets can be multipole magnets. The polarity of the magnets on the inner housing and the rotating member can be configured such that the two magnets magnetically align at desired orientations. For example, the magnets can have eight poles to create eight "index" orientations such that the rotating member and the inner housing will be attracted to these orientations as the rotating member rotates, e.g., at 45 degree intervals. In addition, the strength of the magnets can be configured to adjust the force necessary to rotate the rotating member. The polarity and strength of the magnets can both be configured to provide a smooth transition of the deadbolt and desired number or positions of index orientations.

The method can include transitioning a deadbolt between a locked position and an unlocked position (912). For example, the deadbolt can transition as a user rotates a paddle of the rotating member, as described above. In another example, the deadbolt can transition by other means, such as a key or by an actuator within the main housing in response to receiving a wireless signal. In some embodiments, transitioning the deadbolt between a locked position and unlocked position (912) can cause the rotating member to rotate. For example, the rotating member can be engaged with a fitting in the inner housing, the fitting in the inner housing engaged with a prong of the outer housing. If the prong of the outer housing rotates as the deadbolt transitions between a locked position and an unlocked position, then the rotating member can also rotate accordingly.

Processing System

Figure 10:
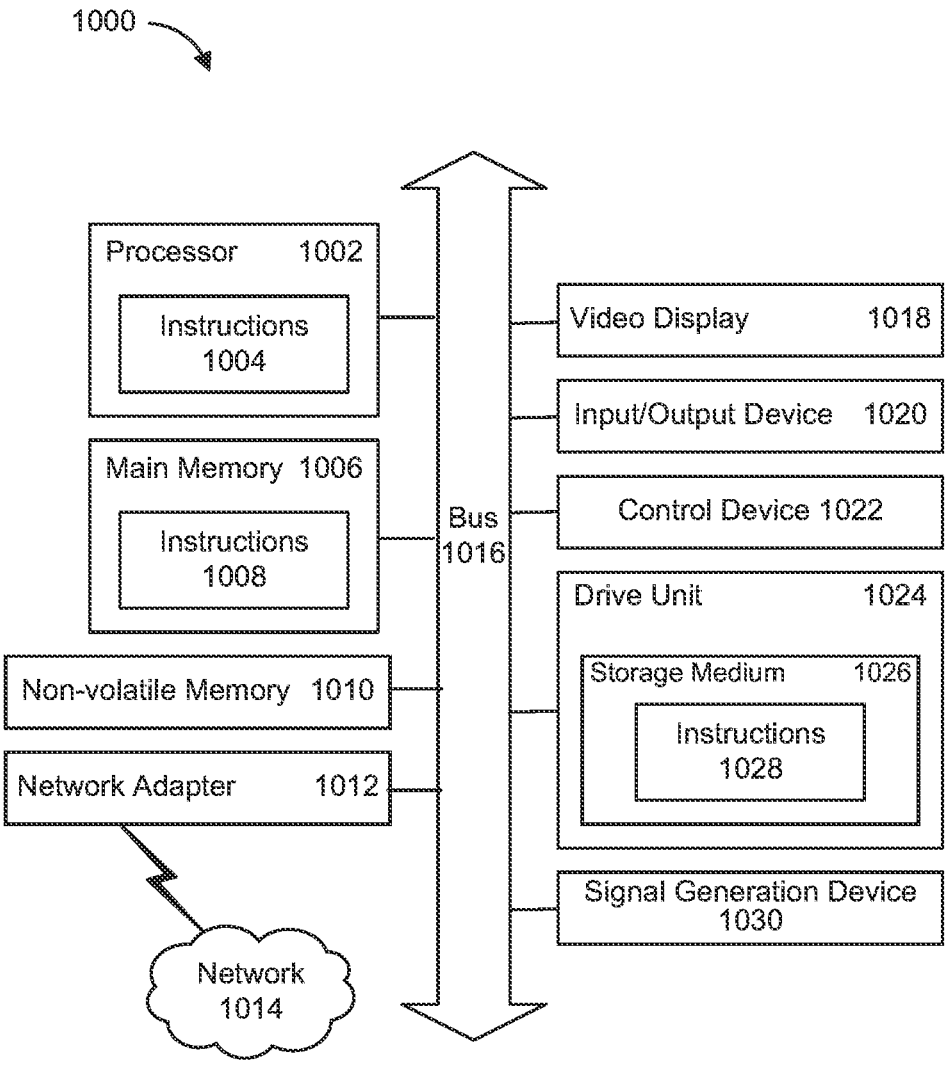
FIG. 10 is a block diagram illustrating an example of a processing system in which at least some operations described herein can be implemented.

FIG. 10 is a block diagram illustrating an example of a processing system in which at least some operations described herein can be implemented. For example, some components of the processing system 1000 can be hosted on an electronic device as described in the present embodiments.

The processing system 1000 can include one or more central processing units ("processors") 1002, main memory 1006, non-volatile memory 1010, network adapter 1012 (e.g., network interface), video display 1018, input/output devices 1020, control device 1022 (e.g., keyboard and pointing devices), drive unit 1024 including a storage medium 1026, and signal generation device 1030 that are communicatively connected to a bus 1016. The bus 1016 is illustrated as an abstraction that represents one or more physical buses and/or point-to-point connections that are connected by appropriate bridges, adapters, or controllers. The bus 1016, therefore, can include a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus (i.e., "Firewire").

The processing system 1000 can share a similar computer processor architecture as that of a desktop computer, tablet computer, personal digital assistant (PDA), smartphone, game console, music player, wearable electronic device (e.g., a watch or fitness tracker), network-connected ("smart") device (e.g., a television or home assistant device), virtual/augmented reality systems (e.g., a head-mounted display), or another electronic device capable of executing a set of instructions (sequential or otherwise) that specify action(s) to be taken by the processing system 1000.

While the main memory 1006, non-volatile memory 1010, and storage medium 1026 (also called a "machine-readable medium") are shown to be a single medium, the term "machine-readable medium" and "storage medium" should be taken to include a single medium or multiple media (e.g., a centralized/distributed database and/or associated caches and servers) that store one or more sets of instructions 1028. The term "machine-readable medium" and "storage medium" shall also be taken to include any medium that is capable of storing, encoding, or carrying a set of instructions for execution by the processing system 1000.

In general, the routines executed to implement the embodiments of the disclosure can be implemented as part of an operating system or a specific application, component, program, object, module, or sequence of instructions (collectively referred to as "computer programs"). The computer programs typically comprise one or more instructions (e.g., instructions 1004, 1008, 1028) set at various times in various memory and storage devices in a computing device. When read and executed by the one or more processors 1002, the instruction(s) cause the processing system 1000 to perform operations to execute elements involving the various aspects of the disclosure.

Moreover, while embodiments have been described in the context of fully functioning computing devices, those skilled in the art will appreciate that the various embodiments are capable of being distributed as a program product in a variety of forms. The disclosure applies regardless of the particular type of machine or computer-readable media used to actually effect the distribution.

Further examples of machine-readable storage media, machine-readable media, or computer-readable media include recordable-type media such as volatile and non-volatile memory devices 1010, floppy and other removable disks, hard disk drives, optical disks (e.g., Compact Disk Read-Only Memory (CD-ROMS), Digital Versatile Disks (DVDs)), and transmission-type media such as digital and analog communication links.

The network adapter 1012 enables the processing system 1000 to mediate data in a network 1014 with an entity that is external to the processing system 1000 through any communication protocol supported by the processing system 1000 and the external entity. The network adapter 1012 can include a network adaptor card, a wireless network interface card, a router, an access point, a wireless router, a switch, a multilayer switch, a protocol converter, a gateway, a bridge, bridge router, a hub, a digital media receiver, and/or a repeater.

The network adapter 1012 can include a firewall that governs and/or manages permission to access/proxy data in a computer network and tracks varying levels of trust between different machines and/or applications. The firewall can be any number of modules having any combination of hardware and/or software components able to enforce a predetermined set of access rights between a particular set of machines and applications, machines and machines, and/or applications and applications (e.g., to regulate the flow of traffic and resource sharing between these entities). The firewall can additionally manage and/or have access to an access control list that details permissions including the access and operation rights of an object by an individual, a machine, and/or an application, and the circumstances under which the permission rights stand.

The techniques introduced here can be implemented by programmable circuitry (e.g., one or more microprocessors), software and/or firmware, special-purpose hardwired (i.e., non-programmable) circuitry, or a combination of such forms. Special-purpose circuitry can be in the form of one or more application-specific integrated circuits (ASICs), programmable logic devices (PLDs), field-programmable gate arrays (FPGAs), etc.

Conclusion

Unless contrary to physical possibility, it is envisioned that (i) the methods/steps described above may be performed in any sequence and/or in any combination, and that (ii) the components of respective embodiments may be combined in any manner.

The techniques introduced above can be implemented by programmable circuitry programmed/configured by software and/or firmware, or entirely by special-purpose circuitry, or by a combination of such forms. Such special-purpose circuitry (if any) can be in the form of, for example, one or more application-specific integrated circuits (ASICs), programmable logic devices (PLDs), field-programmable gate arrays (FPGAs), etc.

Software or firmware to implement the techniques introduced here may be stored on a machine-readable storage medium and may be executed by one or more general-purpose or special-purpose programmable microprocessors. A "machine-readable medium", as the term is used herein, includes any mechanism that can store information in a form accessible by a machine (a machine may be, for example, a computer, network device, cellular phone, personal digital assistant (PDA), manufacturing tool, any device with one or more processors, etc.). For example, a machine-accessible medium can include recordable/non-recordable media (e.g., read-only memory (ROM), random access memory (RAM), magnetic disk storage media, optical storage media, flash memory devices, etc.).

Any of the steps as described in any methods or flow processes herein can be performed in any order to the extent the steps in the methods or flow processes remain logical.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described but can be practiced with modification and alteration within the spirit and scope of the appended claims. Accordingly, the specification and drawings are to be regarded in an illustrative sense rather than a restrictive sense.

What is claimed:

1. An electromechanical door lock comprising:

a main housing configured to be disposed inside of a bore hole of a door, the main housing including an actuator configured to extend a deadbolt to a locked position and retract the deadbolt to an unlocked position, a wireless communication component, and a conductive cuff opening that is electrically connected to a power source;

an outer housing configured to be disposed exterior of the door, the outer housing including a bolt sleeve extending through the conductive cuff opening of the main housing, wherein the bolt sleeve is conductive and mounts a bolt and the outer housing is configured to electrically draw power from the main housing via contact to the conductive cuff opening via the bolt sleeve, and a capacitive touch sensor;

an inner housing configured to be disposed exterior of the door opposite the outer housing, the inner housing engaging with a distal end of the bolt sleeve of the outer housing; and wherein the deadbolt transitions between the locked position and the unlocked position when the capacitive touch sensor detects a touch of a user and the wireless communication component detects a wireless communication signal from a user device associated with the user.

2. The electromechanical door lock of claim 1, further comprising:

a first magnet with a first polarity attached to the inner housing; and a rotating member including a second magnet with a second polarity, wherein the rotating member is magnetically engaged to the inner housing and the deadbolt transitions between the unlocked position and the locked position upon rotation of the rotating member.

3. The electromechanical door lock of claim 1, wherein the outer housing includes a leakage region configured to be disposed adjacent to the door, the wireless communication signal transmitting through the leakage region.

4. A door lock comprising:

a deadbolt within a bolt housing;

a main housing configured to be disposed interior of a bore hole of a door and configured to cause the deadbolt within the bolt housing to transition between a locked position and an unlocked position, the main housing including a conductive passthrough ring that is configured to electrically connect to a power source; and an outer housing including a bolt sleeve, wherein the bolt sleeve is conductive and mounts a bolt, the bolt sleeve further enabling the outer housing to draw electrical power from the main housing when the bolt sleeve is connected to the conductive passthrough ring of the main housing.

5. The door lock of claim 4, further comprising:

an inner housing connected to the outer housing, the inner housing including a first magnet with a first polarity; and a rotating member including a second magnet with a second polarity, the rotating member magnetically engaging the inner housing, and wherein the deadbolt transitions between the unlocked position and the locked position upon rotation of the rotating member.

6. The door lock of claim 5, wherein the bolt sleeve is engaged with the inner housing.

7. The door lock of claim 4, wherein the outer housing includes a capacitive touch sensor, and wherein the deadbolt transitions between the unlocked position and the locked position when the capacitive touch sensor is activated.

8. The door lock of claim 4, further comprising a wireless communication component, wherein the deadbolt transitions between the unlocked position and the locked position when the wireless communication component receives a signal from a user device.

9. The door lock of claim 8, wherein the signal from the user device is a Bluetooth wireless protocol signal.

10. The door lock of claim 8, wherein the wireless communication component is within the outer housing, and the signal from the user device is a near-field communication signal.

11. The door lock of claim 4, wherein the outer housing includes a leakage region that allows wireless signal transmission through the outer housing.

12. The door lock of claim 11, wherein the leakage region is configured to be disposed adjacent to the door.

13. The door lock of claim 4, further comprising a power supply disposed within the deadbolt.

14. The door lock of claim 13, further comprising a bolt cap engaged with the deadbolt, the bolt cap configured to electrically connect the power supply with the main housing.

15. A method of operating a door lock comprising:

disposing a bolt housing including a deadbolt within a door;

disposing a main housing within a bore hole of the door, the main housing being electrically and mechanically connected to the deadbolt;

connecting a bolt sleeve of an outer housing to the main housing, the outer housing including a capacitive touch sensor, wherein the bolt sleeve is conductive and mounts a bolt;

drawing electrical power, by the capacitive touch sensor of the outer housing, from a conductive passthrough ring of the main housing via the bolt sleeve;

detecting, by the capacitive touch sensor, a touch of a user; and transitioning the deadbolt between a locked position and an unlocked position in response to detecting the touch of the user.

16. The method of claim 15, further comprising:

associating the door lock with a user device;

detecting the user device is within a wireless communication range of the door lock; and transitioning the deadbolt between the locked position and the unlocked position in response to detecting the user device and detecting the touch of the user.

17. The method of claim 15, further comprising connecting an inner housing to the bolt sleeve of the outer housing, the inner housing configured to magnetically engage a rotating member.

18. The method of claim 15, further comprising engaging a bolt cap to the deadbolt, the bolt cap configured to electrically connect a power supply with the main housing.

19. The method of claim 15, further comprising extending the bolt housing to an extended position.

* * * * *